US007552486B2

(12) United States Patent
Kaempfen

(10) Patent No.: US 7,552,486 B2
(45) Date of Patent: Jun. 30, 2009

(54) STOWABLE MEZZANINE BED

(76) Inventor: Nicolas Kaempfen, 9, Rue Des Noirettes, Carouge (CH) CH-1227

( * ) Notice: Subject to any disclaimer, the term of this patent is extended or adjusted under 35 U.S.C. 154(b) by 309 days.

(21) Appl. No.: 10/572,392

(22) PCT Filed: Jul. 20, 2004

(86) PCT No.: PCT/IB2004/002459

§ 371 (c)(1),
(2), (4) Date: Dec. 18, 2006

(87) PCT Pub. No.: WO2005/025380

PCT Pub. Date: Mar. 24, 2005

(65) Prior Publication Data

US 2007/0074342 A1 Apr. 5, 2007

(30) Foreign Application Priority Data

Sep. 18, 2003 (EP) ..... 03021084

(51) Int. Cl.
*A47C 19/04* (2006.01)

(52) U.S. Cl. ..... 5/9.1; 5/10.2

(58) Field of Classification Search ..... 5/9.1, 5/8, 10.1, 10.2; 296/190.02
See application file for complete search history.

(56) References Cited

U.S. PATENT DOCUMENTS

| | | | |
|---|---|---|---|
| 3,745,595 | A | 7/1973 | Nagy |
| 3,829,912 | A | 8/1974 | Quakenbrush |

FOREIGN PATENT DOCUMENTS

| | | |
|---|---|---|
| CH | 678 145 | 2/1989 |
| DE | G 86 16 939.4 | 8/1986 |
| EP | 0 172 146 | 2/1986 |
| FR | 2 591 876 | 6/1987 |
| FR | 2 729 062 | 7/1996 |

*Primary Examiner*—Alexander Grosz
(74) *Attorney, Agent, or Firm*—Young & Thompson

(57) ABSTRACT

A device serving as a mezzanine fold-away bed provided with a support structure and a frame (20), wherein a fold-away mechanism allows the frame to be folded away from a use position to a stow-away position. This mechanism includes two shafts situated on the frame, each of these shafts being connected via a tie-rod to a pivot on the support, structure in order to tie the frame to the support structure, and also includes a mechanism that synchronizes the movement of the two shafts.

10 Claims, 6 Drawing Sheets

STOWABLE MEZZANINE BED

Object of the present invention is a device serving as a fold-away mezzanine bed having a support structure fitted with a frame, where a fold-away mechanism allows the bed frame to be folded away from a first or use position to a second or stow-away position.

DESCRIPTION OF THE RELATED ART

Devices of this kind are known in general, and have the purpose of making available a convertible piece of furniture. The piece of furniture thus can be used in a first position, and can then be converted to its second position so as to liberate space. In the present case the piece of furniture may serve as a bed during the night, to be converted during the day so as to make available more space in the room.

The document FR 2,729,062 more particularly describes a fold-away bed consisting of a support structure, a frame, and a mechanism that allows the frame to be placed at a number of different heights in the horizontal so that the bed can be used or stowed away. The fold-away mechanism used in this case works with electric drives including more particularly a motor.

A similar device is presented in the document CH 678,145, in which case the structure serving as support is fixed at the ceiling of the room that is supposed to be fitted with the convertible piece of furniture.

These devices utilize electric drives necessitating an appropriate arrangement in the piece of furniture to house the motor and supply the power for the motor. From an aesthetic viewpoint and in view of the space taken up by these drives, this has unfavorable consequences, in particular for a piece of furniture serving as a bed. The use of electric drives implies limited possibilities for installing and using such a piece of furniture. Also, if the support is attached to the ceiling of a room, this detracts from flexibility in the use of this piece of furniture. In addition, production costs and the risks of breakdowns are relatively high for this kind of a fold-away mechanism.

SUMMARY OF THE INVENTION

It is the aim of the present invention to realize a device conducive to obviating the above disadvantages of current systems.

Object of the present invention is a device serving as a fold-away mezzanine bed having the characteristics set forth in claim 1.

In particular, the fold-away mechanism of the device has two shafts mounted on a bed frame, each of these shafts being connected to a pivot on a support structure via a tie-rod so as to link the frame to the support structure, as well as a mechanism of synchronization of the movement that links these two shafts and imposes a synchronized rotation on them.

In an embodiment the fold-away mechanism has at least one small tie-rod on each shaft, these small tie-rods being articulated on arms so as to form a deformable parallelogram imposing a synchronized rotation on the two shafts.

It is thus possible to realize a simple mechanical fold-away mechanism not involving electrical elements. By reducing the number of parts and optimizing their positions, the mechanism is arranged to be effective and simple so as to reduce the production and maintenance costs. It is readily installed within a box that is naturally integrated into the frame holding the bed's box-mattress in order to have an esthetically attractive appearance of the piece of furniture.

The mechanism may also include at least one segment and one lever or two segments that are placed on the shafts and are interconnected by one or several springs. The spring delivers a force that facilitates the change-over from one frame position to the other. The fold-away mechanism thus provides for a handling as comfortable as that offered by the electrical drive while the space required to house this mechanism can be reduced, thus improving the appearance of the piece of furniture and enhancing its flexibility of use.

The convertible piece of furniture according to the present invention thus can serve as a bed in its use position but readily allows space to be liberated in its stow-away position, so that one may use a writing-desk, table, or other items installed beneath the bed frame.

Other advantages will become apparent from the characteristics expressed in the dependent claims and from the description hereinafter setting forth the invention in greater detail with the aid of drawings.

BRIEF DESCRIPTION OF THE DRAWINGS

The appended drawings represent in a schematic and exemplary fashion an embodiment of the invention.

-DETAILED DESCRIPTION OF THE PREFERRED EMBODIMENTS

The invention will now be described in detail while referring to the annexed drawings that illustrate an embodiment of the invention serving as an example.

Figure 1B:
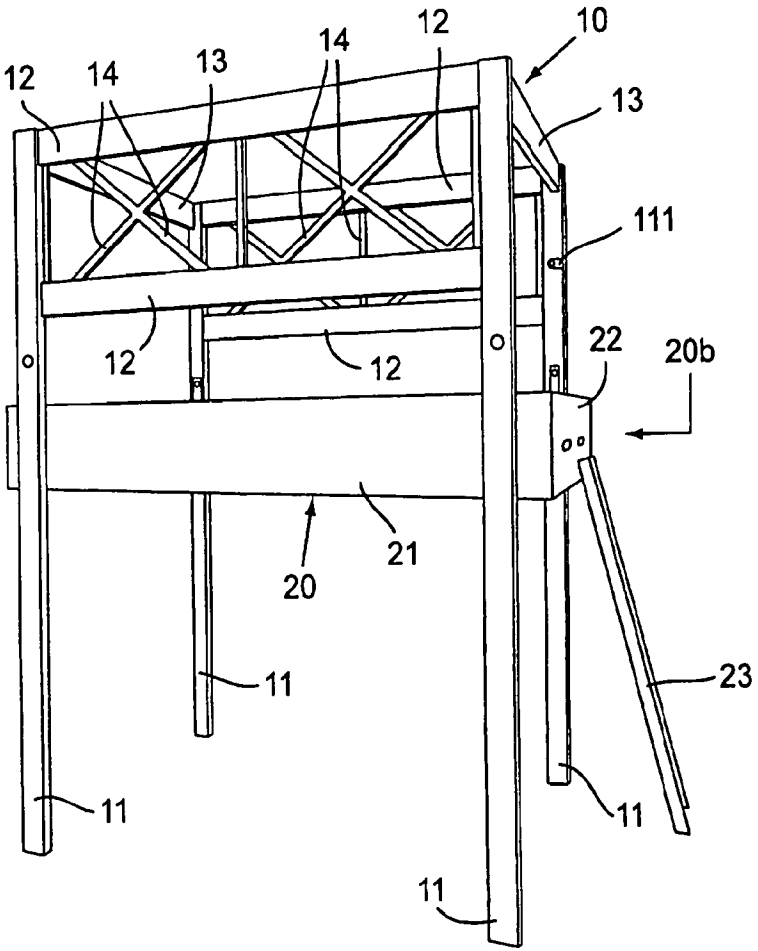
FIGS. 1*a* and 1*b* show the device in perspective side views in its stow-away position and in its use position.
Figure 1A:
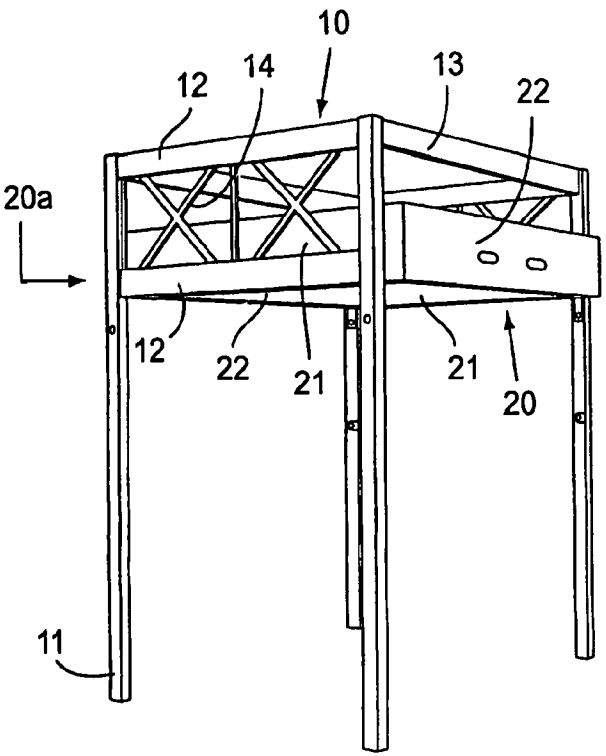

Referring to FIGS. 1*a* and 1*b* it will be noticed at the outset that the fold-away bed according to the present invention is an independent setup constituting a fold-away mezzanine bed.

This mezzanine bed consists of a support structure 10 formed by four vertical posts 11 linked together by a rigid structure 12, 13, 14, in order to secure the stability and rigidity of the setup.

Figure 2:
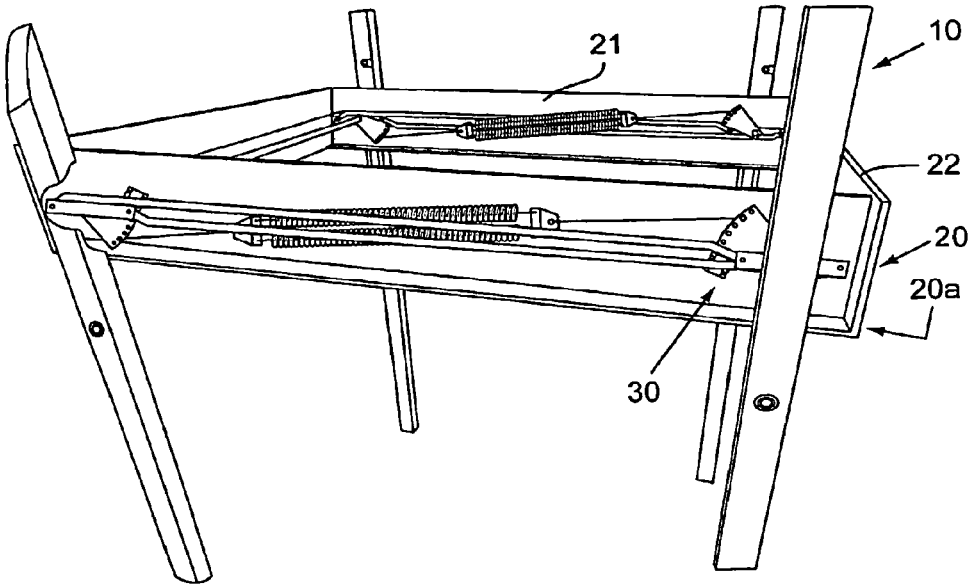
FIG. 2 is a perspective view of the frame in its stow-away position.

This support structure 10 holds a horizontal frame 20 normally formed by two longitudinal boxes 21 linked by two cross planks 22 as indicated in FIG. 2, where the sides of the boxes 21 which in this view hide the fold-away mechanism are omitted. The frame 20 could equally well be formed by two transverse boxes linked by two longitudinal planks, with appropriate changes in the places of the fold-away mechanisms as will become evident from the following explanation. In another embodiment relying on a simpler and asymmetric fold-away mechanism, frame 20 could be formed by one box and one corresponding beam replacing the second box, where these two parts would again be tied together by two planks.

Figure 3:
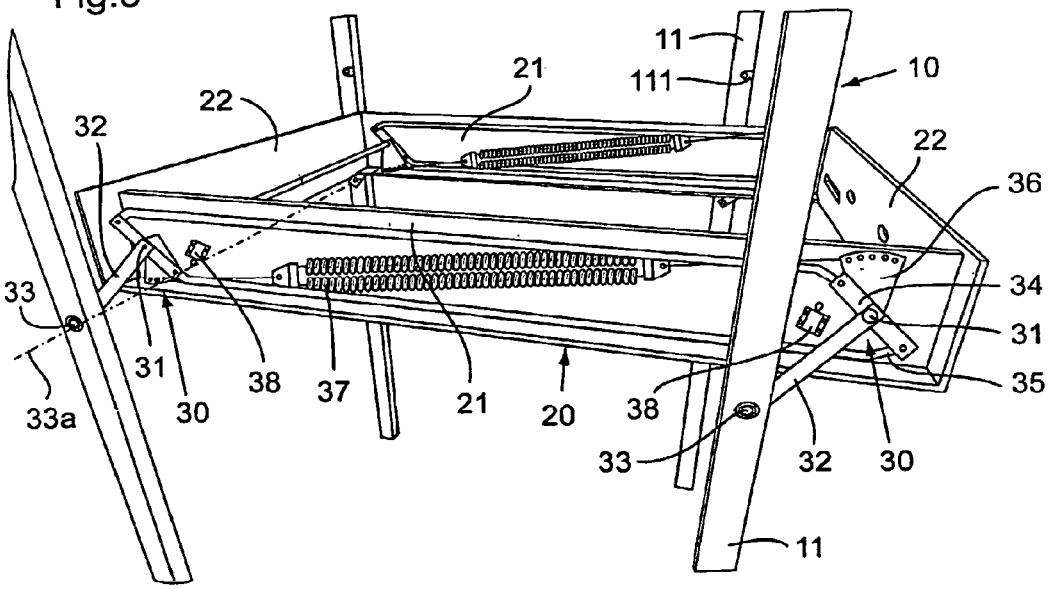
FIG. 3 represents in a perspective view an intermediate position of the frame close to its stow-away position, with certain parts of the frame omitted as in FIGS. 2 and 6*a* to 6*e* in order to reveal more particularly the fold-away mechanism.

Each box 21 of the frame 20 holds a fold-away mechanism 30 having two shafts 31, as seen in FIG. 3 where the outside respectively inside wall of the boxes is omitted in order to reveal the details of mechanism 30. A shaft 31 of one fold-away mechanism 30 may physically traverse the entire frame 20 while connecting two fold-away mechanisms 30 in the boxes 21 located on either side of the frame 20, or may merely have the length that corresponds to the thickness of one box 21. Preferably at least one of the two shafts 31 of a fold-away mechanism 30 traverses the frame 20 as shown in FIG. 3. Each of these shafts 31 is linked by a tie-rod 32 at its outer ends to a pivot 33 present in each post 11 of the support structure 10. The place of pivot 33 in the posts 11 as well as the lengths of the tie-rods 32 are selected so that on one hand in its stow-away position the frame 20 liberates enough space so that the space underneath this frame 20 can be used, and that on the other hand the position of use of the bed and particularly of the frame 20 is at a convenient height. The device may also be fitted with a ladder 23 over which the user may climb into the bed without any effort, as shown in FIG. 1*b*.

Each shaft 31 of the fold-away mechanism 30 of each box 21 bears at least one small tie-rod 34, the ends of the two rods 34 of two shafts 31 being articulated on arms 35 so as to form a deformable parallelogram imposing a synchronized rotation on the two shafts 31. Preferably two opposite sides of the frame 20, either longitudinal or transverse, are fitted with a fold-away mechanism, which implies that arms 35 will be located in two boxes 21 located at two opposite sides of the frame 20. In the case of an asymmetric fold-away system the second box may be replaced by a simple beam as mentioned above, where this beam only has a pivot 33 tied with a rod 32 to shaft 31, rather than having a complete fold-away mechanism 30. In the preferred case of two boxes 21, the fold-away system of a frame 20 has two fold-away mechanisms 30 and hence is symmetric. The small tie-rods 34 are preferably mounted perpendicularly to the corresponding tie-rod 32, as illustrated in FIG. 3, and arms 35 have an arched portion at each of their ends which serve to round the corners of the deformable parallelogram in order to admit a maximum approach of arms 35 in the horizontal position of tie-rod 34, that is, in the stow-away position 20*a* and in the use position 20*b* of frame 20 where the articulations between tie-rods 34 and arms 35 must find room between the two corresponding arms 35. This set of tie-rods 34 and arms 35 forms a mechanism synchronizing the movement of shafts 31.

Figure 7:
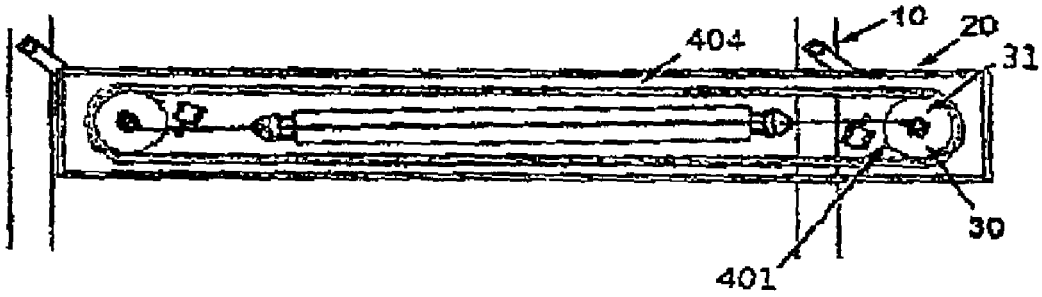
FIG. 7 provides a schematic illustration of an alternate embodiment of the mechanism for synchronizing the shafts of the invention.

One variant among several others, of the above solution shown schematically in FIG. 7 for forming such a mechanism synchronizing the movement comprises at least one pinion 401 per shaft 31. these pinions being connected through a chain 404 in order to form a kinematic connection imposing a synchronized rotation of the two shafts 31. It is obvious that the set of pinion and chain is equivalent to the mechanism using tie-rods 34 and arms 35, and the remarks of the preceding paragraph are analogously applicable to this solution.

The mechanism synchronizing the movement which is placed on the shafts 31 and connects these two shafts 31 while imposing a synchronized rotation of the two shafts 31 is part of the fold-away mechanism 30, and can thus be realized in different ways.

It is clear after this description of the connection between frame 20 and support structure 10 or of the fold-away mechanism 30 that the position of use 20*b* and the stow-away position 20*a* of frame 20 in the device according to the present invention are located at the two sides of the pivoting shafts 33*a* of frame 20, that is, of the pivots 33 of the support structure.

Each shaft 31 of the fold-away mechanism 30 of each box 21 may also have at least one segment 36, the two segments 36 of one mechanism 30 being linked through one or several springs 37. The force of springs 37 helps lifting the frame and damps the descending movement of frame 20. The force of springs 37 can be adjusted through the segments 36 mentioned above, insofar as the springs 37 or the corresponding intermediate links, for instance a wire between a segment 36 and a spring 37, may be fastened at a number of places along the periphery of each segment 36, thus subjecting the springs 37 to a tension that is more or less strong and allowing at the same time the angle of attack of a spring to be modified. One or even two segments 36 may also be replaced by a simple lever while limiting or even eliminating the possibility of varying the force exerted by the springs 37 on the segments 36. This set of segments and springs thus acts as a device driving the fold-away mechanism and facilitating the displacement of the frame by the user. To cite an alternative solution, this arrangement could for instance be replaced by helical springs mounted individually on shafts 31.

Figure 4A:
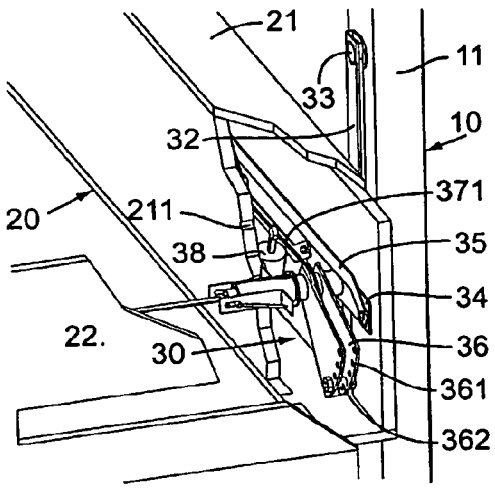
FIGS. 4*a* to 4*c* illustrate the mechanism for adjusting the force of the springs to be included in the fold-away mechanism.
Figure 4B:
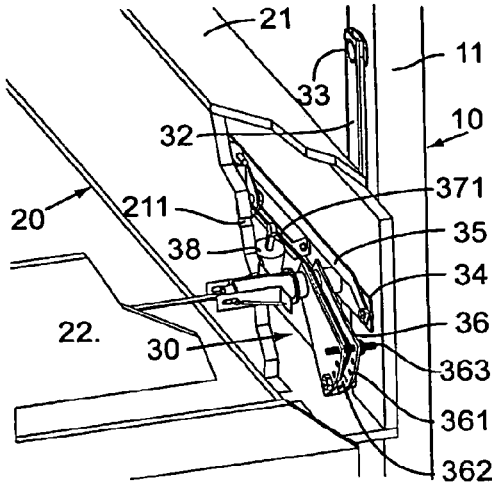
Figure 4C:
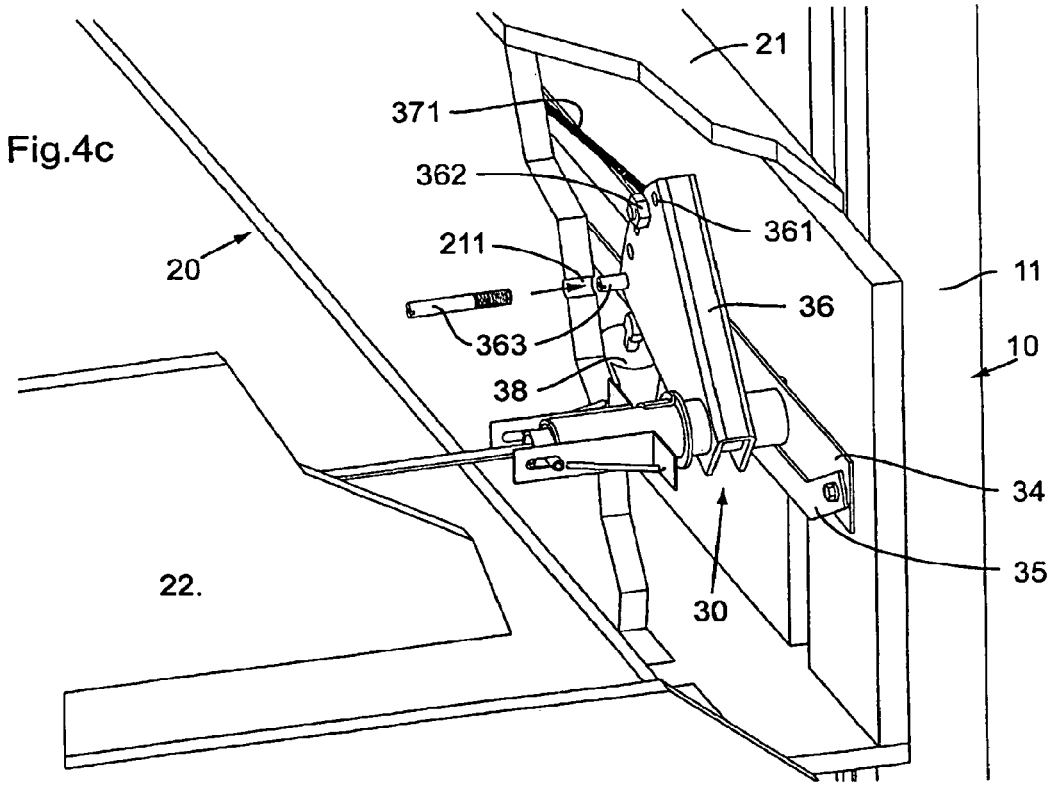

FIGS. 4*a* to 4*c* show in detail one of the possible realizations of such a segment 36 at which a wire 371 is fastened which connects it with a corresponding spring 37. Along the periphery of this segment 36, several holes 361 are arranged into which a locking pin 362 can be introduced at which the wire 371 mentioned above is fastened, as shown in FIG. 4*a*. By modifying the place of locking pin 362 on the periphery of the segment one can adjust the tension exerted by spring 37 as well as its angle of attack relative to segment 36. Using an extension pin 363 that in addition to the locking pin is introduced into another hole 361 along the periphery of this segment 36, and by having the wire 371 pass over this extension pin 363, the tension of spring 37 can be further raised while modifying the angle of attack as before; this arrangement is illustrated in FIG. 4*b*. Other possibilities for an adjustment of the tension exist, for instance by winding wire 371 onto the locking pin 362 by rotating this pin, which to this end may be realized as a screw. For an easy introduction of pins 362 and/or 363 and an easier adjustment after final assembly of the bed, holes 211 are provided in the inner planks of boxes 21 of a frame 20, for instance facing the holes 361 of segment 36 when frame 20 is in the stow-away position 20*a*. These holes 211 and the pins 362 and 363 are illustrated in FIG. 4*c*, where the extension pin 363 is shown in its free position and in its inserted position.

Several possibilities of assembly exist in particular for the parts of the fold-away mechanism 30. When shafts 31 are idle when installed in frame 20, for instance with the aid of roller bearings or of simple openings, then the tie-rods 32, the small tie-rods 34 and, where applicable, the segment 36 are fastened rigidly relative to each other and, preferably, also relative to these shafts 31. The shafts a 31 may also be fastened at frame 20, in which case the tie-rods 32, the small tie-rods 34 and, where applicable the segments 36 are fastened rigidly relative to each other while shafts 31 are idle in this setup. A similar remark applies to pivots 33, which are mounted so as to pivot either in the tie-rods 32 or in the posts 11 (or in both).

Figure 5A:
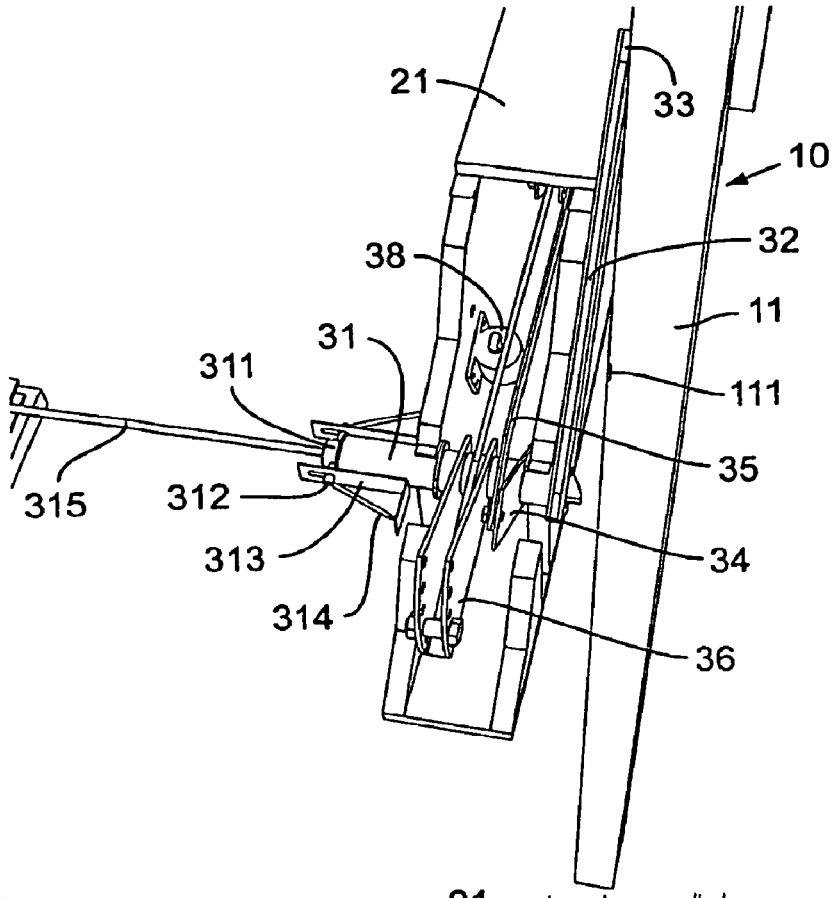
FIGS. 5*a* and 5*b* show the locking device.
Figure 5B:
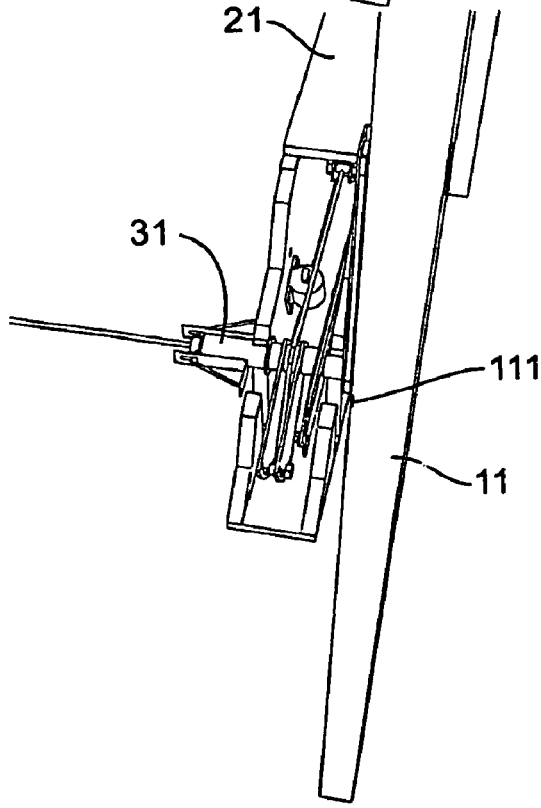

The device may also include a locking device which allows frame 20 to be locked in at least one of its extreme positions. This locking device may be integrated into the shafts 31 as illustrated in FIGS. 5*a* and 5*b*. To this end, preferably one shaft 31 of one fold-away mechanism is realized as a pipe having a length that approximately corresponds to the thickness of one box 21, and is mounted so as to pivot in frame 20 while forming a rigid setup with tie-rod 32, small tie-rod 34 and, where applicable, segment 36. In this shaft 31 is housed a cylindrical body 311, a pipe or a cylinder having a length slightly in excess of that of shaft 31. Body 311 is bevel-cut at its outer end facing post 11 of support structure 10, and bears a pin 312 at its inner end. A guide 313 having grooves receiving pin 312 of body 311 is fixed in such a way at frame 20 that it restricts the motion of body 311 in shaft 31 in the forward and backward direction while at the same time hindering its rotation. At least one spring 314 allows body 311 to be pushed outward, but this body is able to retreat into the interior of frame 20 when its outer, bevel-cut end touches post 11. The latter is fitted with at least one stop, for instance in the shape of a notch 111 formed in the post in front of the places where body 311 arrives in the low and/or high position of frame 20. Under the action of the force of spring(s) 314, body 311 may be caught in notch 111 in the post, and thus lock frame 20 in its stow-away position up or in its use position down. By withdrawing body 311 with a string 315, for instance, frame 20 can be unlocked again. The locking device may also be positioned elsewhere in box 21, rather than being placed into shaft 31, so long as it will continue to cooperate with the support structure 10. Generally, this locking device may for instance be provided at the front portion of the bed, preferably on each side, so that physically the front shaft will be in two parts while the rear shaft of the bed may be a single part in order to better synchronize the motions of the frame while physically connecting the two fold-away mechanisms 30 housed in two boxes 21 on either side of frame 20.

In addition, a damping device 38 may be provided on frame 20 or on support structure 10. This damping device 38, as shown in FIG. 5*a*, may consist of a hydraulic stop placed into a box 21 in such a way that it cooperates with the fold-away mechanism 30, for instance with a segment 36, in order to damp frame 20 when pushed to the high position 20*a* by springs 37. It could also consist of a spring, a rubber band or any other element able to fill this damping function, while the cooperation could be arranged with the small tie-rod 34, the tie-rod 32, or any other part of the fold-away mechanism 30.

Figure 6A:
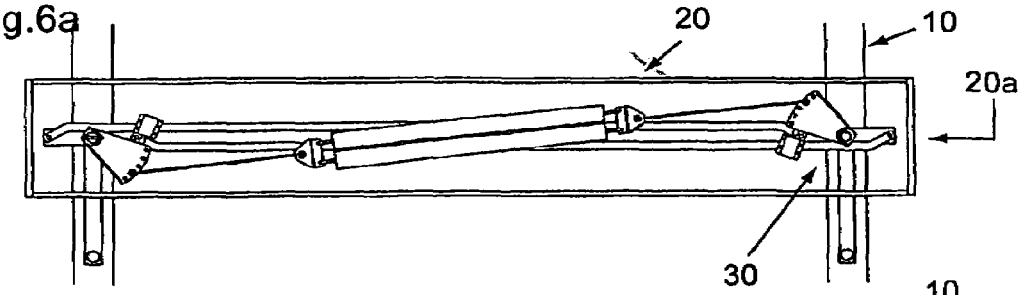
FIGS. 6*a* to 6*e* represent a sequence of positions of the frame during its movement from its stow-away position to its use position.
Figure 6B:
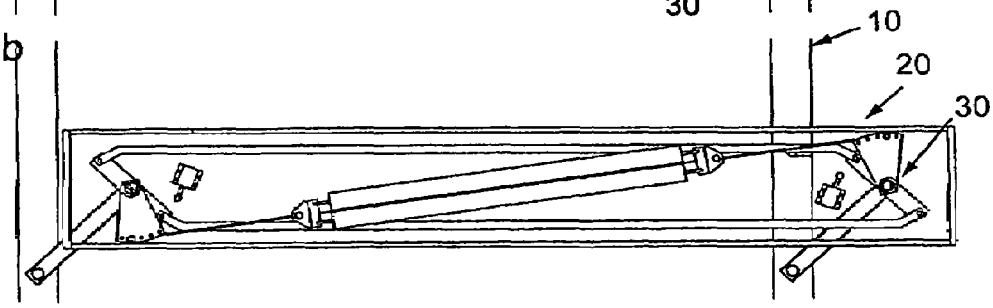
Figure 6C:
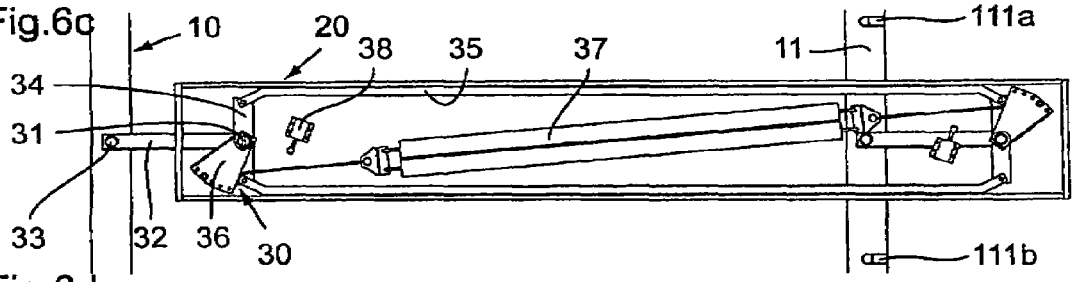
Figure 6D:
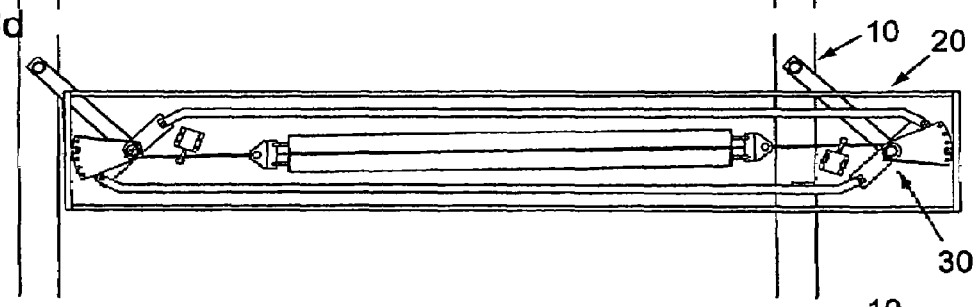

With the sequence of FIGS. 6*a* to 6*e* one can explain the functioning of the device. FIG. 6*a* shows frame 20 in its high position, that is, in the stow-away position 20*a*. By pulling horizontally, possibly after having unlocked frame 20 with the aid of string 315, at one of the transverse planks 22 which, to this end, may contain holes serving as a handle, frame 20 moves forward and downward while remaining horizontal, its intermediate positions being illustrated in FIGS. 6*b* and 6*c*, and then back and downward, see FIG. 6*d*, its displacement ending in the low use position 20*b* illustrated in FIG. 6*e*. In this position the frame is once more locked if it is fitted with the locking device described above. It should be pointed out that during this displacement, springs 37 stretch and balance the weight of frame 20, thus allowing an easy and smooth displacement to be performed. The force exerted by springs 37 increases starting from the stow-away position 20*a*, becomes largest in the intermediate position of FIG. 6*d*, and then diminishes slightly toward the use position 20*b*. It can be adjusted with the aid of the segments 36 and pins 362 and 363 mentioned above, which form a mechanism for adjusting the force of springs 37.

Figure 6E:
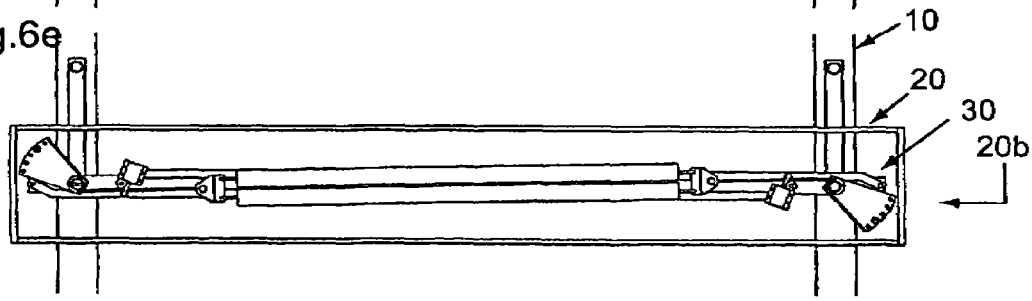

Pulling once more on the cross plank 22 one returns from the low position illustrated in FIG. 6*e* to the high position of frame 20 illustrated in FIG. 6*a*. For this ascending movement, the force of springs 37 helps lifting the frame in such a way that the force required for this lifting is minimal, the frame may even be self-lifting through the force of the springs which, instead of a locking device, may even hold the frame in its high position. Close to the stow-away position 20*a* the damping device will damp the movement of frame 20 that is driven by the force of springs 37, for instance by acting on segments 36 of the fold-away mechanism 30 as illustrated in FIG. 6*a*.

Frame 20 may serve as support for a box mattress and overlay mattress in order to constitute a fold-way mezzanine bed. The dimensions of frame 20 depend on the desired bed size, and may for instance correspond to a single bed or a double bed.

It is equally well possible to provide two frames 20 on the support structure 10, so as to have a two-story fold-away bed. In this case the lengths of the tie-rods 32 and the places of pivots 33 of these two frames 20 are preferably selected so that the stow-away positions 20*a* of the two frames 20 are rather close to each other while the use positions 20*b* are similar to the positions of the mattresses of normal two-story beds. In this case the planes of motion of tie-rods 32 of the two frames 20 must be slightly offset in order to allow tie-rod 32 of the lower frame to move past pivot 33 of the upper frame.

Summarizing, it should be observed that the mezzanine fold-away bed according to the present invention is chiefly characterized by the following characteristics: It has a support structure, this support structure is fitted with a frame. A mechanism allows the frame to be folded away from a low first position of use to a high second stow-away position. Placed on the frame, this mechanism includes two shafts, each being connected with a tie-rod to a pivot on the support structure in order to tie the frame to the support structure. It also includes a mechanism synchronizing the movement which links these two shafts and imposes a synchronized rotation on the shafts. This mechanism synchronizing the movement may be realized by at least one small tie-rod on each shaft, these rods being articulated on arms in order to form a deformable parallelogram imposing a synchronized rotation of the two shafts. Preferably, the fold-away mechanism also includes at least one segment and a lever or two segments, again situated on these shafts, which are tied together by one or several springs in order to have a driving device yielding a force that facilitates the displacement of the frame from one position to the other.

The device according to the present invention thus provides a convertible piece of furniture that can serve as a bed by night in its use position but takes up little space by day in its stow-away position, this objective being attained in a simple, effective and inexpensive way because of the characteristics mentioned above.

The invention claimed is:

1. A device serving as a mezzanine fold-away bed, comprising:

a support structure (10) having a pivot (33) and equipped with at least one frame (20), and a fold-away mechanism (30) configured to fold the frame (20) from a first use position (20*b*) to a second stow-away position (20*a*), the fold-away mechanism (30) comprising two shafts (31) mounted on the frame (20), each of these shafts (31) being linked by a tie-rod (32) to the pivot (33) on the support structure (10) to link the frame (20) to the support structure (10), the fold-away mechanism (30) also comprising a synchronizing mechanism configured to synchronize a movement connecting the two shafts (31) and to impose a synchronized rotation on the two shafts (31), wherein the synchronizing mechanism comprises a first element (34) connected to each shaft (31) and second elements (35) kinematically connecting external ends of the first elements (34) to stabilize the synchronized movement of the shafts (31), and wherein each of the first elements comprise a small tie-rod (34) provided on each shaft (31), the second elements comprise arms (35) configured to articulate the tie-rods (34), and the arms (35) and the tie-rods (34) define a deformable parallelogram configured to impose a synchronized rotation upon the two shafts (31).

2. The device according to claim 1, wherein the fold-away mechanism (30) comprises a driving device on the shafts (31), the driving device including a segment (36) on a first of the shafts (31) and one or more springs (37) connecting the segment of the one of the shafts to a second of the shafts (31) so as to transfer a force between the shafts (31) facilitating the movement of the frame (20) between the second stow-away position (20*a*) the first use position (20*b*).

3. The device according to claim 2, wherein one segment (36) is arranged in such a way that the spring(s) (37) can be attached at several positions along the periphery of each segment (36).

4. The device according to claim 3, wherein one segment (36) is provided with holes (361) arranged along a periphery of the one segment (36) configured to receive a locking pin (362) and/or an extension pin (363).

5. The device according to claim 1, further comprising:

a locking device cooperating with a catch (111) placed on the support structure (10) and allowing the frame (20) to be locked in at least one of the use position (20*b*) and the stow-away position (20*a*).

6. The device according to claim 5, wherein the locking device comprises a cylindrical body (311) with an outer end and an inner end, the cylindrical body (311) also having a bevel-cut at the outer end and bearing a pin (312) at the inner end, a guide (313) fastened at the frame (20) configured to receive the pin (312) in such a way that a movement of the body (311) is restrained in a forward and backward direction and a rotation of the body (311) is hindered, while at least one spring (314) pushes the body (311) outwardly, the body configured to retreat into the frame (20) when the outer end touches the support structure (10), and further configured to engage into a catch (111) so as to lock the frame (20), and wherein the locking device further comprises an element (315) configured to withdraw the cylindrical body (311) in order to unlock the frame (20).

7. The device according to claim 1, further comprising:

a damping device (38) cooperating with the fold-away mechanism (30) in order to damp a movement of the frame (20) when driven to the stow-away position (20*a*).

8. The device according to claim 1, wherein the use position (20*b*) and the stow-away position (20*a*) correspond to opposite respective sides of longitudinal axis (33*a*) of the pivot (33).

9. The device according to claim 1, wherein the frame (20) of the device includes two boxes (21) and two planks (22) tying the boxes (21) together, each box (21) holding a fold-away mechanism (30).

10. A device serving as a mezzanine fold-away bed, comprising:

a support structure having a pivot and equipped with at least one frame, and a fold-away mechanism configured to fold the frame from a first use position to a second stow-away position, the fold-away mechanism comprising two shafts mounted on the frame, each of these shafts being linked by a tie-rod to the pivot on the support structure to link the frame to the support structure, the fold-away mechanism also comprising a synchronizing mechanism configured to synchronize a movement connecting the two shafts and to impose a synchronized rotation on the two shafts, wherein the synchronizing mechanism comprises a first element connected to each shaft and a second element kinematically connecting external ends of the first elements to stabilize the synchronized movement of the shafts, and wherein the first element of the mechanism synchronizing the movement comprises a pinion on each shaft, and wherein the second element of the mechanism comprises a chain connecting the pinions of each shaft so as to form a kinematic connection between the two shafts imposing a synchronized rotation of the two shafts (31).

* * * * *